United States Patent [19]

Devlin et al.

[11] Patent Number: 4,895,453

[45] Date of Patent: Jan. 23, 1990

[54] VORTEX MIXER DRIVE

[75] Inventors: William J. Devlin, Newark; Carl F. Morin, Brandywood; Robert K. Wiedenmann, New Castle, all of Del.

[73] Assignee: E. I. Du Pont de Nemours and Company, Wilmington, Del.

[21] Appl. No.: 237,017

[22] Filed: Aug. 24, 1988

[51] Int. Cl.[4] ..... B01F 11/00

[52] U.S. Cl. ..... 366/219; 366/240

[58] Field of Search ..... 366/240, 219, 220, 235, 366/349, 208, 209, 212, 213, 214, 215, 216; 422/99, 50

[56] References Cited

U.S. PATENT DOCUMENTS 3,850,580 11/1974 Moore et al. ..... 23/259
4,118,801 10/1978 Kraft ..... 366/208
4,555,183 11/1985 Thomas ..... 366/208
4,661,408 4/1987 Lau et al. ..... 428/405
4,747,693 5/1988 Kahl ..... 366/219

OTHER PUBLICATIONS

Wada et al., "Automatic DNA sequencer: Computer--programmed microchemical manipulator for the Maxam-Gilbert sequencing method," Review of Scientific Instruments 54(11), Nov. 1983, pp. 1569-1572.

*Primary Examiner*—Robert W. Jenkins

[57] ABSTRACT

An automatic vortexing drive is described in which a rotatable coupling has a cuplike recess positioned off of and opening radially outward from the axis of rotation of the coupling. The coupling is positioned to intercept the lower and reaction vessels in the recess. Selective rotation of the coupling permits the vessels to pass the coupling or be engaged by the coupling and nutated.

14 Claims, 5 Drawing Sheets

14
36
44
70
92
72
90
84
82
80
76
72
62
64
66
60
52
50
59
54
56
58
68

VORTEX MIXER DRIVE

CROSS REFERENCE TO RELATED APPLICATION

Subject matter disclosed herein is disclosed or claimed in copending application Automatic Vortex Mixer filed August 26, 1988, Serial Number 07/237,254 (IP-0755).

1. Field of the Invention

The present invention relates to a noninvasive apparatus for mixing fluids contained within a vessel. In particular, the apparatus for this invention is a coupling which enables a vessel to be engaged and orbited using a single degree of motion of the coupling.

2. Background of the Invention

It is known that creating a vortex in the fluid contained in a vessel is an effective means for mixing the fluid. Common laboratory vortexes use a support cup or a resilient vessel and engage the bottom of the vessel with a receiving surface mounted eccentrically to a motor. This translates the lower end of the vessel in a circular path or orbit at a high speed and thereby creates an effective vortex in the fluid contained in the vessel. Exemplary of this type of device are those disclosed in USP 4,555,183 (Thomas) and 3,850,580 (Moore et al.). These devices are manual in that an operator is required to hold the vessel in contact with the eccentrically movable means to create the vortex in the fluid disposed in the vessel.

Such vortex type device would be extremely advantageous if used in an automated chemical analysis instrument as it is noninvasive and therefore can avoid the concern of contamination associated with an improperly cleaned invasive mixing means.

A device that incorporatesd this type of mixing into an automated testing apparatus is disclosed in an article by Wada et al. entitled "Automotive DNA Sequencer: Computer-programmed Microchemical Manipulator for the Maxam-Gilbert Sequencing Method", Rev. Sci. Instrum. 54(11), November 1983, pages 1569–1572. In the device disclosed in this article, a plurality of reaction vessels are held flexibly in a centrifuge rotor. A rotational vibrator is mounted on a vertically moving cylinder. When mixing is desired, the reaction vessel is positioned in a mixing station directly above the rotational vibrator. The vertically movable cylinder is moved upwardly to contact the bottom of the reaction vessel with the rotary, vibrating rubber portion of the rotational vibrator. The rotational vibrator is then actuated to create the vortex in the fluid contained in the vessel.

This device has the shortcoming that two degrees of motion are required to create a vortex in a reaction vessel located at a mixing station — the rotary motion of the vibrator and the linear motion of the vertically moving cylinder. This requires two separate actuators as well as the additional position sensors and software to properly control them. These extra elements equate to an inherently greater cost and lower reliability than a device that could perform the same function utilizing a single degree of motion.

This is of particular significant in a serial processing chemical analysis instrument in which a plurality of mixing stations are required. In serial instruments reaction vessels are stepped or indexed through various processing positions such as add sample and/or reagent, incubate, wash, mix, etc. Such mixing is desirable in most automated chemical analyzers and can become necessary when solid supports such as glass beads or magnetic particles are used that often have a tendency to sink to the bottom of the reaction vessel. For example, in heterogeneous immunoassays, magnetic particles can be used as the basis for separation of the reagents from ligand-antibody bound particles. A particularly desirable particle for such assays is the chromium dioxide particle disclosed in USP 4,661,408 (Lau et al.). These particles have a tendency to settle at a rate which can be detrimental to the kinetics of the reaction It is therefore desirable that the reaction mixture be mixed regularly during incubation while the reaction is occuring.

SUMMARY OF THE INVENTION

This invention provides an automatic apparatus for establishing a vortex in liquid samples that are contained in reaction vessels disposed on a transport. The apparatus comprises a plurality of vessel carrier disposed on the transport each adapted to hold the upper portion of a reaction vessel, the transport having a line of movement, a rotatable coupling having an axis of rotation and located under the line of movement of the vessel carriers in a position to interdict a reaction vessel held by the transport, the coupling defining a first recess positioned off of and opening radially outward from the axis of rotation; means for rotating the coupling to a first position to engage the lower portion of a reaction vessel and to a second position to permit the reaction vessel and to pass, the means to rotate the coupling rapidly, thereby to orbit the lower end of an engaged reaction vessel. Preferably the coupling recess is configured to engage a stem that may be formed on the bottom of the reaction vessels. This reduces the tendency of the vessels to rotate during orbiting. Also the vessel carrier may include a pair of resilient open prongs adapted to flexibly engage the reaction. The interior of the prongs define longitudinal teeth which are adapted to mate with like grooves or teeth formed on the exterior of the top portion of the reaction vessels to facilitate preventing their rotation. The second off axis recess may be formed on the coupling spaced form the first recess may be formed on the coupling spaced from the first recess so that the reaction vessels may be passed between the recesses when the recesses are not located in a vessel intercept position. A spring may be positioned above the prongs to prevent the upward movement of a reaction vessel during nutation.

With this automatic apparatus, it is apparent that a single degree of motion, i.e., rotary motion is all that is required to either intercept reaction vessels as they are stepped into the position of the vortexing coupling and thereby rotate the vessels. Alternatively by rotating the coupling 90°the reaction vessels may pass directly through the vortexing position without undergoing vortexing and hence mixing of the fluid contents. The apparatus just described is relatively simple, economical to construct, and reliable in operation.

BRIEF DESCRIPTION OF THE DRAWINGS

The invention may be more fully understood from the following detailed description thereof taken in connection with the accompanying drawings which form a part of this invention description and in which similar reference numbers refer to similar elements in all figures of the drawings in which.

DETAILED DESCRIPTION OF THE INVENTION

Figure 1:
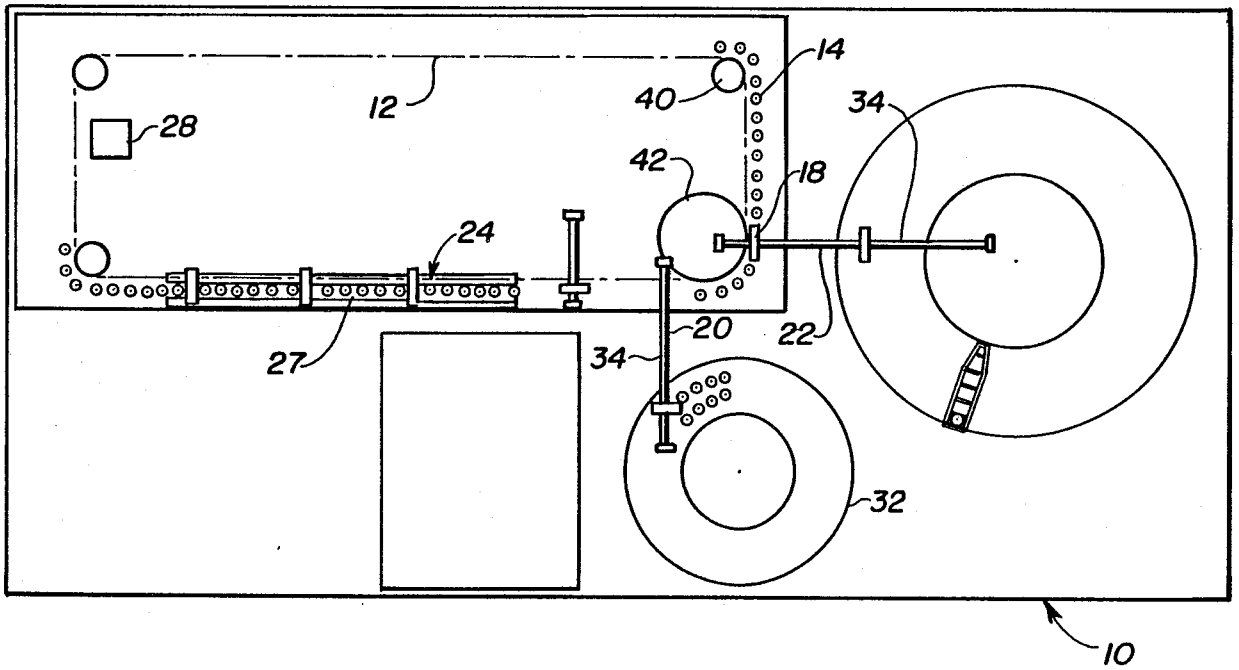
FIG. 1 is a plan view of the processing chamber of an automatic chemical analysis instrument, using a chain transport for the reaction vessels, in which the noninvasive mixing apparatus of this invention may be used.

As may be seen in FIG. 1, a chemical analyzer in which this invention may find use, which may be conventional, includes a processing chamber 10 with a transport 12 which is operable to translate individual reaction vessels 14 in a serial fashion to various processing stations located within the processing chamber. Typically the transport operates in a stepwise manner to step the reaction vessels to each station. The processing stations include a reaction vessel loading station 18, a sample dispensing station 20, a reagent dispensing station 22, wash station 24, a mixing station 27, and a measuring station 28. The processing chamber includes a reagent disc 30, a sample carousel 32 and transfer arms 34 for transferring sample and reagents to the reaction vessels 14.

The reaction vessels 14 are flexibly top mounted to the transport 12, which is illustrated as drive chain 38 (FIG. 3), mounted on sprockets 40. One sprocket 42 is mounted on the shaft of the drive motor (not shown), which, when rotated, causes the drive chain 36 to translate longitudinally along its axis. Equidistantly disposed on the drive chain 38 are a plurality of vessel carriers 44 each operable to receive a reaction vessel 14. While a chain or belt type transport is shown, disc type transports could be used as well.

Figures 2, 3:
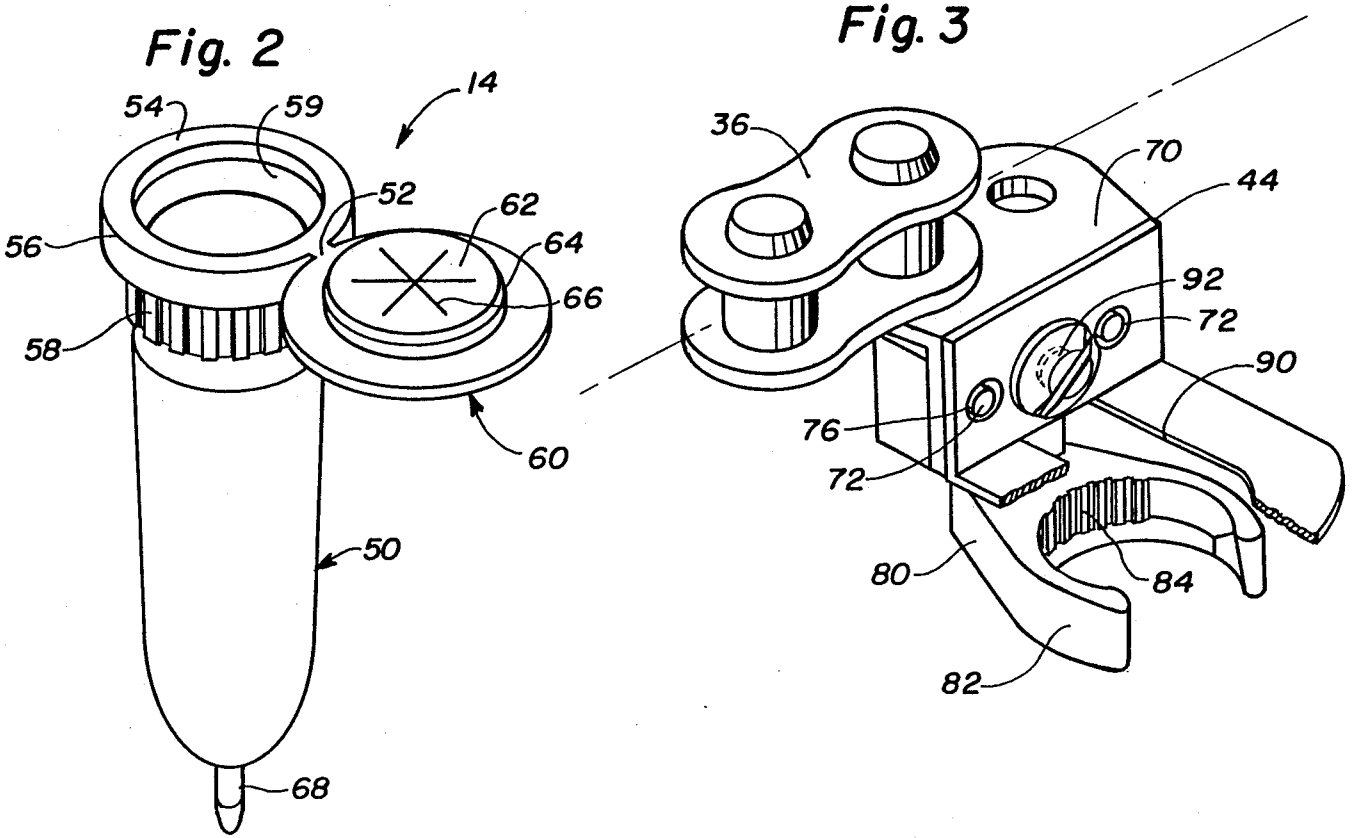
FIG. 2 is an isometric view of a preferred reaction vessel that may be used in the apparatus of this invention.
FIG. 3 is a fragmentary isometric view of the reaction vessel carrier assembly and its mounting details relative to the reaction vessel transport mechanism.

The flexible or resilient mount used for the reaction vessels 14 is best seen in FIGS. 3–6, while the reaction vessel 14 used in conjunction with the apparatus of this invention can be better understood with reference to FIG. 2. The reaction vessel 14 includes a tapered cylindrical body 50 and an integral lid 60 connected to a rim 54 formed at the top of the tapered body 50 by an integrally formed "living" hinge 52. The entire reaction vessel is plastic (preferably polypropylene) and is molded as a unitary assembly. The rim 54 defines a flange 56 and an interior peripherally rounded circumferential groove 59. A plurality of vertically oriented, longitudinal parallel grooves 58 are formed in the exterior of the tapered body immediately below the flange 56. The lid 60 has a cylindrical protrusion 62 which is in the form of a recess in the upper portion of the lid 60 when it is in position. The peripheral portion 64 is in the form of a rounded circumferential lip. A plurality of slits 66, in the form of an asterisk, are formed in the disk-like surface of the recess 62. The slits provide an access passage to the interior of the tapered body and reduce the force required for a probe to access any liquids contained in the reaction vessel formed by the tapered body 50. The entire reaction vessel is molded as a unitary assembly. The lower portion of the tapered body 50 defines a protuberant stem 68 located along the longitudinal axis of the tapered body 50.

To close the reaction vessel 14, the lid 60 is pivoted on the hinge 52 such that the protrusion defining the recess 62 enters the interior of the tapered body 50 such that the lip 64 engages the groove 59. This creates a seal. While the reaction vessel may be made of any suitable known engineering plastic, polypropylene is preferred in that it has the pliability and life necessary for the hinge 52 and is chemically inert so as not to affect reaction which takes place in the vessel itself, is relatively inexpensive, and is easy to mold.

Each reaction vessel is adapted to be flexibly held by a carrier 44. Each carrier 44 is held by a bracket 70 located under and on the outer side of the chain transport 38 secured by a screw 92 and dowel pins 72 which secure a prong clip 80 to the bracket 70. The hole for the screw 92 in the prong clip 80 may use a threaded insert. The dowel pins 72 and the hole in the threaded insert 74 are spaced to line up with clearance holes 76 in the bracket to accommodate the dowel pins 72.

The lower portion of the vessel carrier 44 defines the prong clip 80 which is essentially U-shaped with two prongs 82 extending outwardly from the transport. The prongs 82 define a circular aperture sized to receive the reaction vessel 14. Hence the reaction vessel 14 can be loaded into the clip 80 by pushing it into the gap defined by the ends of the prongs 82. This forces the prongs 82 to deflect and separate thus increasing the gap and allowing the reaction vessel 14 to enter this circular aperture. The prongs snap back after the reaction vessel has entered the circular aperture in order to hold the reaction vessel in place. The diameter of the circular aperture and the diameter of the reaction vessel in the vicinity of the longitudinal grooves 58 are the same. The interior of the prong clip 80, as defined by the prongs has a series of longitudinal teeth 84. These teeth 84 are sized and spaced to mate with the longitudinal grooves 58 formed in the reaction vessel 14 thus inhibiting relative rotation of the reaction vessel while in the clip.

The prong clip 80 is molded as a unitary assembly and may be made from ABS plastic designated Cycolac 17. This material, one of the many engineering plastics can be used for this purpose was chosen for its strength and fatigue properties and corrosion resistance.

An L-shaped hold-down spring 86 is engaged by the dowl pins 72 and screw 92. The long portion of the L is formed with a slight incline 88 and the leading edge itself is formed in a semicircular shape. Furthermore, the spring 86 is somewhat U-shaped so as to define an aperture 90 to facilitate probe access to the reaction vessels 14. The spring 86 may be made from stainless spring steel.

Figure 4:
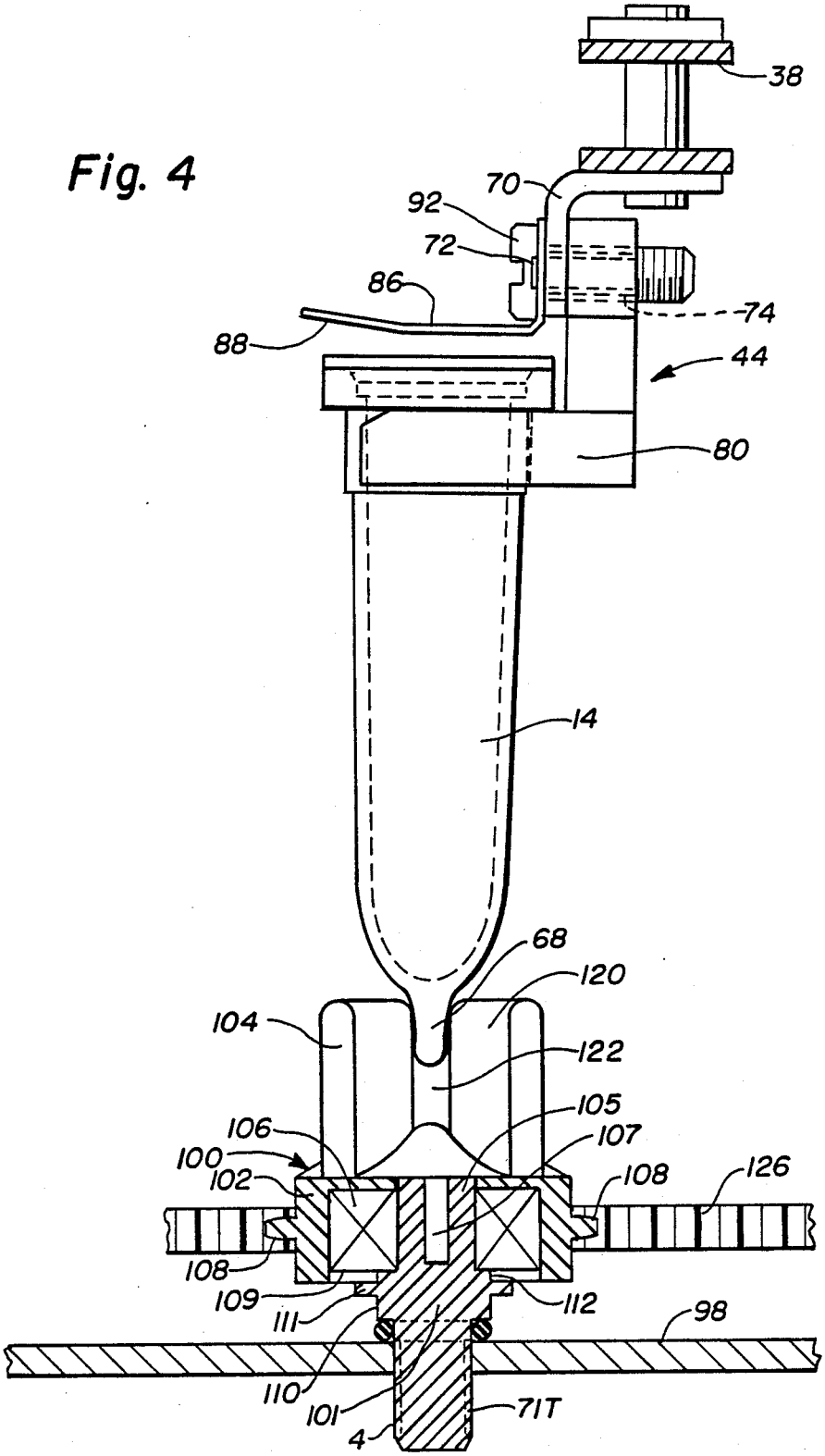
FIG. 4 is a side elevation, partially in section view, taken along lines 4—4 in FIG. 1.

Throughout the processing of the reaction vessel 14, there is a need to mix the fluids contained therein in order to improve the kinetics of the reaction. To this end, a plurality of mixing stations 27, constructed in accordance with this invention, are disposed at various locations along the path of the reaction vessels 14. The configuration and operation of these mixing stations can best be understood with reference to FIGS. 1, 4, 5, 6 and 7. Each mixing station 27 includes a coupling 100 (FIG. 4). The coupling may be fabricated from an acetal copolymer material such as that which can be obtained from E.I. du Pont de Nemours and Company, Wilmington, Delaware under the designation Delrin 550. This material is preferred because of its strength, its moldability and its low coefficient of friction. Any suitable engineering of course may be used. The coupling 100 comprises a lower drive portion 102 and an upper reaction vessel capture portion 104. The lower drive portion 102 is substantially cylindrical in shape. A recess 109 is formed in the lower region of the lower drive portion 102. Sprocket teeth 108 extend from the periphery of the lower drive portion 102. These teeth are used to transmit torque to the coupling through a drive chain 126.

Figure 5:
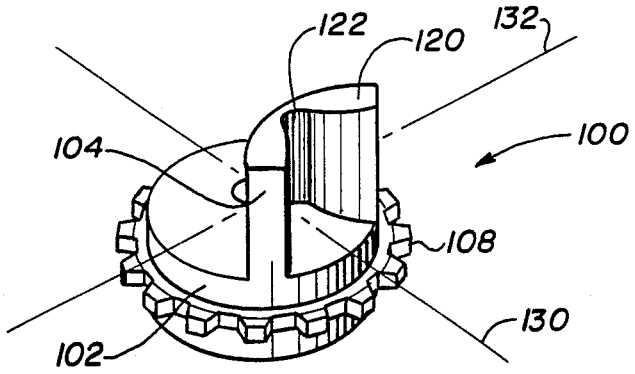
FIG. 5 is an isometric view of one of the embodiments of the coupling utilized in this invention.

In one embodiment, shown in FIG. 5 the reaction vessel capture portion 104 of the coupling 100 is a single receiving cup 120. The cup 120 extends upwardly from the lower drive portion 102. The cup 120 is arcuate in shape and is essentially a sector of a hollow cylinder with a circular recess 122 formed in the inner wall. Generally, it may be described as U-shaped. The lower drive portion 102, the cup 120 and the recess 122 all share a common axis 124 (FIG. 7A). The cup 120 is located on the coupling 100 such that the recess 122 of the cup 120 is off of the axis 124 and thus the recess 122 is closer to the periphery of the coupling 100 than the outside of the cup 120 at the same point. The position or distance of the recess 122 from the axis 124 is the mixing eccentricity that will be imparted to the reaction vessel.

As can be best seen in FIG. 4, the coupling 100 is mounted to a baseplate 98 of the instrument in a way that allows relative rotation of the coupling 100. A stainless steel support member 101 is formed with a lower threaded portion. Located above the threaded portion is a series of flanges 80, 111 and 112, respectively. Extending from the uppermost flange 112 is a cylindrical shaped bearing shaft 105. A guideway 107 is cut into the end of the bearing shaft 105 and extends to the uppermost flange 112. The guideway 107 facilitates the use of flat-bladed screwdriver to screw the support member 101 into the baseplate. An O-ring is captured between the lower flange 110 and the baseplate 98 of the instrument in order to prevent leakage below the baseplate. The bearing shaft 105 diameter is sized to be interference fit with the inner diameter of a roller bearing 106.

A mixing drive chain 126 driven by a motor (not shown) in the analyzer (FIG. 1) mates with the sprocket teeth 108 of all the couplings 70 disposed in the processing chamber 10. The mixing drive chain 126 is driven in a unidirectional fashion. Thus, all couplings disposed in the processing chamber can be caused to rotate using a single actuator. An idler mechanism is placed in communication with the mixing drive chain 126 in order to eliminate any slack that might exist. It should be noted that while this single actuator design is the preferred embodiment, each coupling or a subset of couplings could have its own actuator and remain in the scope of this invention.

In operation, the drive chain 38 (12 in FIG. 1) periodically is translated the distance between two adjacent vessel carriers 44. This periodicity or time interval is referred to as a "step". As the drive motor 20 only requires only a few seconds to move the chain this distance, there is a dwell each step during which the chain is stationary and the reaction vessels 14 are available for processing. In this manner, the reaction vessels loaded onto the drive chain 36 are stepped past the various processing stations.

Figure 7B:
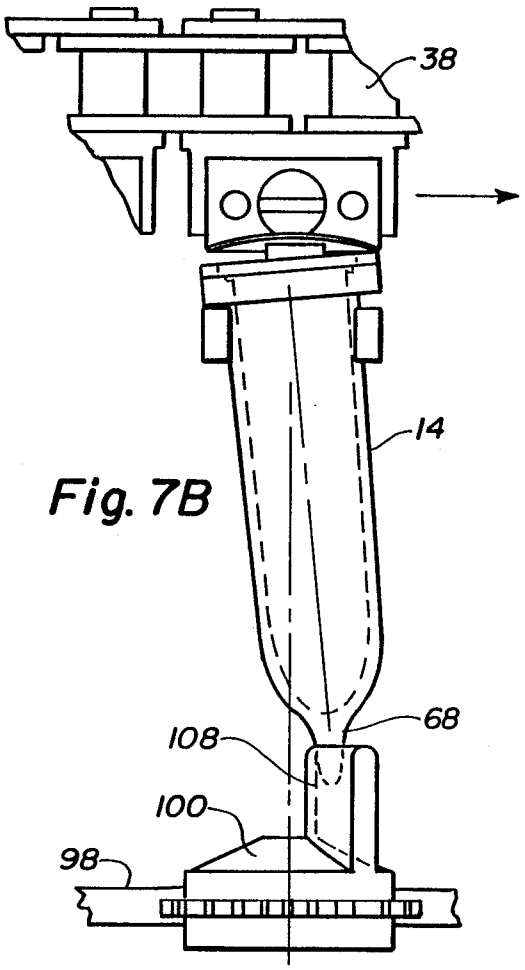
FIG. 7A and 7B are front elevation views depicting the operational relationship between the coupling and the reaction vessel.
Figure 7A:
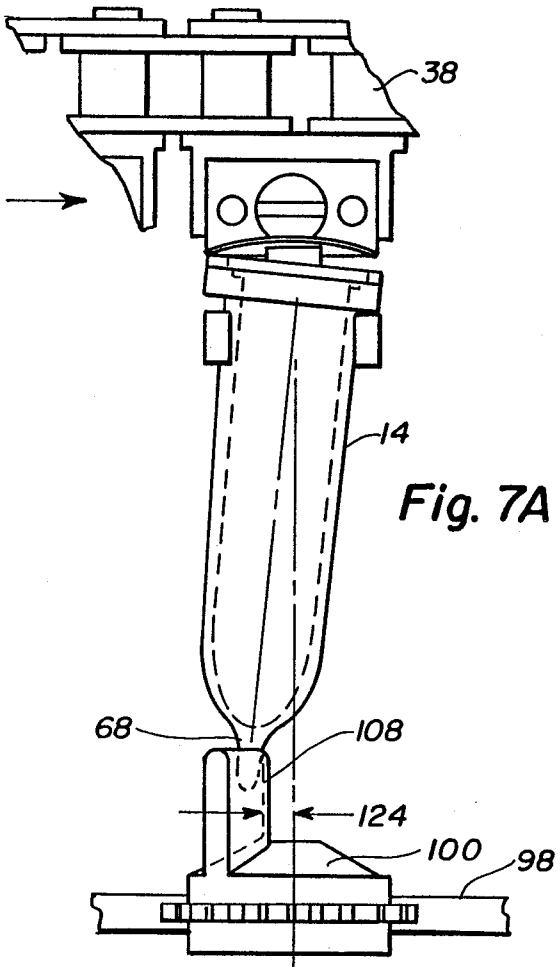

The operation of the mixing mechanism is depicted in FIGS. 7A–7B. Each coupling 100 is aligned such that the axis 130 is collinear with the path of the reaction vessel 14 at each processing location of the reaction vessel. Additionally, each coupling 100 is aligned such that the cup 90 is positioned toward the incoming reaction vessel 14. The drive chain 36, loaded with reaction vessels 14, advances towards the mixing stations 27 until the vessel carriers 44 holding reaction vessels 14 are aligned directly above the coupling 100.

As shown in FIG. 7A, in this position the reaction vessels are tilted as the stem 68 of the reaction vessels 14 are received in the cup 120 of each coupling 100. These reaction vessels 14 are now in position for mixing. The mixing drive chain 98 is translated. As shown in FIG. 7B, this causes all couplings 100 in contact with the mixing drive chain 126 to rotate thereby pivoting the lower portion of the reaction vessels while the upper portion of the reaction vessels are flexibly held by the vessel carriers 44. The longitudinal teeth 84 are of the prong clip 80 mate with the longitudinal grooves 59 of the reaction vessels 14 to prevent any rotation of the reaction vessels 14 relative to the clip 80. The hold down spring 86 acts as a vertical stop to keep the reaction vessel 14 captured in the clip 80. The couplings 100 are rotated at a suitable speed, for vortexing. This creates a vortex in the liquid contained in each reaction vessel 14 located at a mixing position 27.

When the mixing cycle is completed, the couplings 100 are positioned such that they are rotated 180°from their initial reaction vessel receiving position to that illustrated in FIG. 7B. This is to allow the stems 68 to become disengaged from the cups 120 of the couplings 100 during the next step movement of the drive chain 36. During this next drive chain 16 movement, once the stems 68 are free from the cups 120 of the couplings 100, the couplings are caused to rotate 180 degrees back to the reaction vessel receiving position of FIG. 7A where they receive the next reaction vessel to be mixed.

The couplings 100 are designed such that the reaction vessels can be allowed to pass through the mixing stations 27 without being captured. This is particularly advantageous during an instrument cycle where mixing of the contents of the reaction vessels is not desired. To accomplish this, the coupling 100 is rotated 90°from its initial reaction vessel receiving position. At this position, an obstruction free path 132 through the coupling 100 is afforded to the stem 68. Should each coupling 100 be afforded with its own actuator, this would enable selective mixing at the mixing positions. By selective mixing it is meant that mixing may or may not be conducted in a given mixing position on the reaction vessel 14 contained therein.

Figure 6:
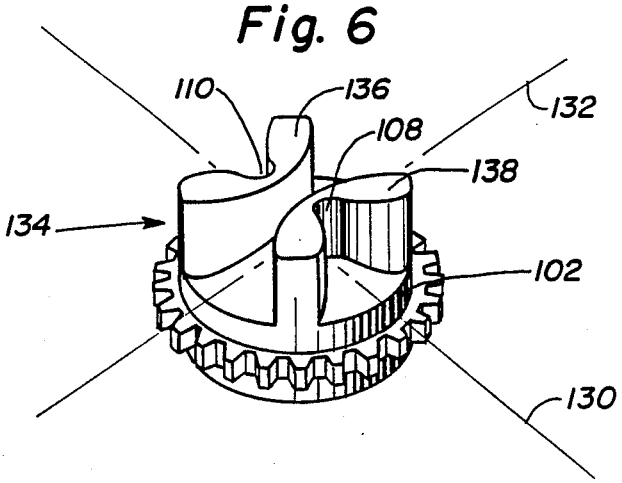
FIG. 6 is an isometric view of a further embodiment of the coupling utilized in this invention.

In another embodiment, as shown in FIG. 6, a coupling 134 contains two cups 136 and 138, with U-shaped or circular recesses 108 and 110 respectively, located directly opposite of each other. This coupling 134 operates in much the same manner as the single cup embodiment. The first cup 134 receives the stem 68 and causes the contents of the reaction vessel 14 to be mixed. Ninety degree rotation permits the stem 68 to pass between the cups. After mixing, the coupling 134 is rotated 180°from the initial reaction vessel receiving position to allow the stem 68 to be disengaged. However, as the second cup 138 is already located in the reaction vessel receiving position, coupling 132 is not required to rotate the 180°back to position the first cup 136 in the reaction vessel receiving position prior to receiving the next reaction vessel 14. The second cup 138 therefore reduces the amount of movement required of the coupling 102.

The advantages of this unique vortexing apparatus are manifold. Firstly, it is simple and requires only one degree of movement, i.e., rotational. This rotational movement is translated by the cup or cups of the coupling device into an orbital movement. The cup engages the stem of a reaction vessel to provide such orbital movement which in turn creates vortexing within the vessel. Thus only the bottom of the tube need be moved in the orbital manner to create the vortex while the top of the tube is flexibly and nonrotatably held.

We claim:

1. An automatic apparatus for establishing a vortex in liquid samples contained in reaction vessels disposed on a transport comprising:

a plurality of vessel carriers disposed on the transport, each adapted to hold the upper portion of a reaction vessel, the transport having a line of movement, a rotatable coupling having an axis of rotation and located under the line of movement of the vessel carriers in a position to interdict a reaction vessel held by the transport, the coupling defining a first recess positioned off of and opening radially outward from the axis of rotation;

means for rotating the coupling to a first position to engage the lower portion of a reaction vessel and to a second position to permit the reaction vessel and to pass, and means to rotate the coupling rapidly, thereby to orbit the lower end of an engaged reaction vessel.

2. An automatic apparatus as set forth in claim 1 wherein the coupling recess is configured to engage a stem extending downwardly from the lower end of a reaction vessel.

3. An automatic apparatus as set forth in claim 1 wherein each vessel carrier includes a pair of resilient, open prongs adapted to flexibly engage a reaction vessel.

4. The apparatus as set forth in claim 3 wherein the prongs define an aperture corresponding to the outer periphery of a reaction vessel.

5. The apparatus as set forth in claim 4 wherein the interior of the aperture defines longitudinal teeth, adapted to engage like grooves formed on the exterior of the upper portion of a reaction vessel.

6. The apparatus as set forth in claim 4 wherein the coupling defines a second off-axis recess opposite the first recess, with an opening between the recesses located under the line of movement to permit passage of reaction vessels held by the transport.

7. The apparatus as set forth in claim 1 wherein the coupling defines a second off-axis recess opposite the first recess, with an opening between the recesses located under the line of movement to permit passage of reaction vessels held by the transport.

8. The apparatus as set forth in claim 7 wherein the coupling recess is configured to engage and a stem extending downwardly from the lower end of a reaction vessel.

9. The apparatus as set forth in claim 8 wherein each vessel carrier includes a pair of resilient, open prongs adapted to flexibly engage a reaction vessel.

10. The apparatus as set forth in claim 9 wherein the prongs define an aperture corresponding to the outer periphery of a reaction vessel.

11. The apparatus as set forth in claim 10 wherein the interior of the aperture defines longitudinal teeth, and the exterior of the upper portion of the reaction vessels each define longitudinal grooves adapted to be engaged by the teeth.

12. The apparatus as set forth in claim 11 wherein the recess is U-shaped.

13. The apparatus as set forth in claim 12 wherein the vessel carrier includes a spring member positioned above the prongs to limit upward movement of a reaction vessel.

14. The apparatus as set forth in claim 9 wherein the vessel carrier includes a spring member positioned above the prongs to limit upward movement of a reaction vessel.

* * * * *